US005911520A

United States Patent [19]

Kenney

[11] Patent Number: 5,911,520

[45] Date of Patent: Jun. 15, 1999

[54] PORTABLE SHOWER APPARATUS

[76] Inventor: Daniel R. Kenney, 312 Chinook Dr., Placentis, Calif. 92870

[21] Appl. No.: 08/874,183

[22] Filed: Jun. 13, 1997

[51] Int. Cl.[6] ..... A47K 3/22

[52] U.S. Cl. ..... 4/615; 4/603

[58] Field of Search ..... 4/602, 603, 617, 4/618, 598, 615, 616

[56] References Cited

U.S. PATENT DOCUMENTS

| | | | |
|---|---|---|---|
| 3,080,568 | 3/1963 | Burnett | 4/602 |
| 4,192,464 | 3/1980 | Chow | 239/373 |
| 4,280,643 | 7/1981 | Cordova et al. | 4/617 X |
| 5,111,538 | 5/1992 | Chapman | 4/603 X |
| 5,570,840 | 11/1996 | Gettinger et al. | 239/112 |

*Primary Examiner*—Robert M. Fetsuga
*Attorney, Agent, or Firm*—Howard R. Lambert

[57] ABSTRACT

A portable water shower apparatus comprises a pressure vessel capable of withstanding an internal pressure of at least about 50 psig. The vessel, which may be sized to hold from about 1 to about 2¼ gallons of water, is formed having an liquid filling and emptying opening and a combination handle and manual pressurizing pump which seals the opening against pressure loss when the vessel is pressurized. The vessel has a pressurized fluid outlet fitting and the apparatus includes an elongate liquid discharge conduit which is detachably attached to the vessel outlet fitting and which has a manually-operated shower head attached to the distal end of the hose for controlling the flow of pressurized liquid from the vessel. A conventional valve stem is provided for the vessel enabling the vessel to be pressurized by use of a $CO_2$ device available in bicycle shops. A pressure relief valve is mounted to the vessel to prevent over-pressurizing the vessel. Temperature and pressure gauges are provided as is a manually-operated valve for venting pressure from the vessel. An insulating cover, having an attached pouch for carrying articles, is installed over the vessel.

10 Claims, 2 Drawing Sheets

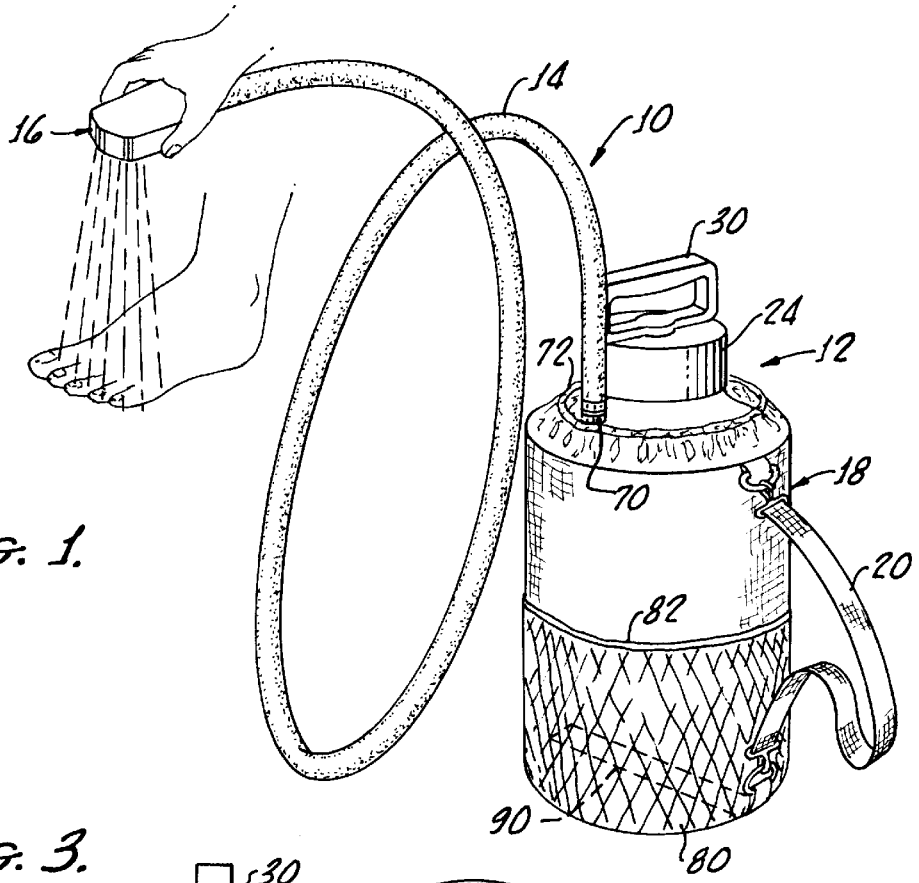
FIG. 1.
FIG. 3.
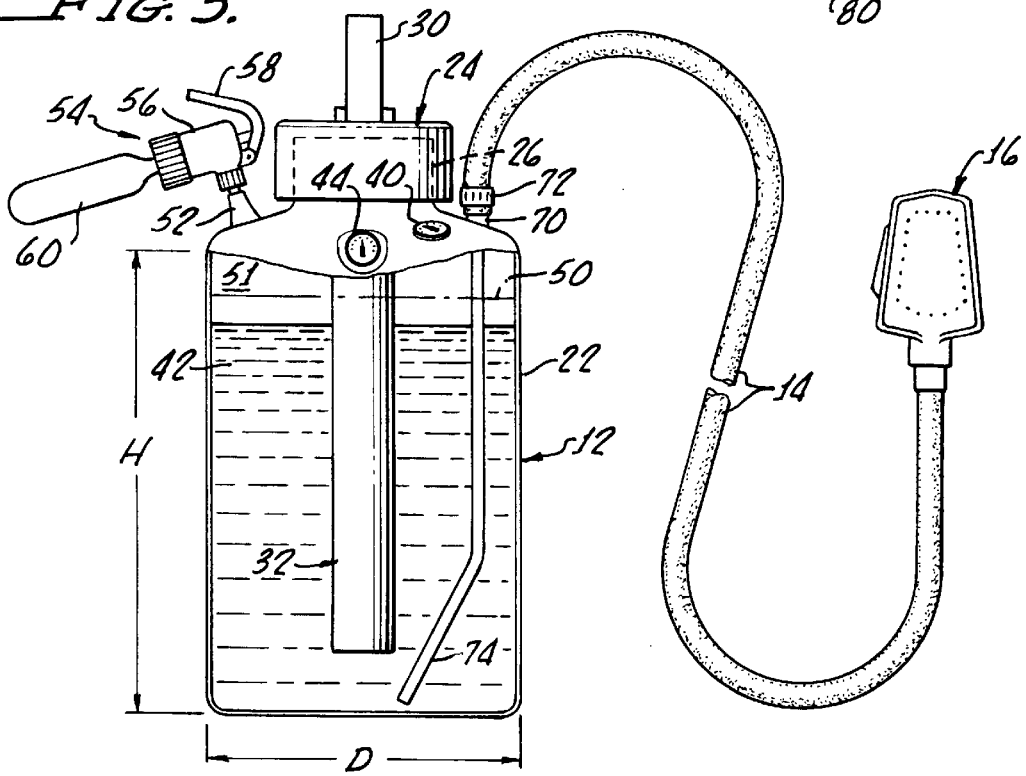

PORTABLE SHOWER APPARATUS

BACKGROUND OF THE INVENTION

1. Field of the Invention

The present invention relates generally to the field of water shower apparatus, more particularly to portable water shower apparatus, and still more particularly to portable water shower apparatus having a self-contained water supply.

2. Background Discussion

Several applications exist for which a portable shower apparatus can be of great benefit. An important one of such applications is in the field of HealthCare and another is in the field of out-door activities.

In the HealthCare field, one of the many difficulties associated with caring for non-ambulatory, chair-bound or bed-bound patients is the challenge and complexity of maintaining personal hygiene of such patients, as is important not only to the physical health of such patients but also, just as importantly, to the mental health and wellbeing of the patients. As an example, several nurses and/or aids are currently often needed to move non-ambulatory patients to showering facilities. The alternative is to sponge-bathe and/or pitcher-rinse the patient. These applications are laborious and time consuming and only partially effective.

As an another example, today's HealthCare professionals have heretofore had only two methods available to them for cleaning and rinsing a non-ambulatory patients' hair. One method involves the application of a dry powder or granular material which is brushed through the patient's hair and then removed. The other method involves the application of a cleansing gel which is rubbed into the patient's hair and is then rinsed off by pouring a container of warm water over the patient's head.

With respect to participating in many outdoor activities, one of the disadvantages is that the participant often gets dirty, and in at least the hot months of the year, typically gets both dirty and sweaty. For example, after a day at an ocean beach, an individual becomes uncomfortable with dried-on salt and may also be sweaty and covered with sand, especially if he or she has been engaged in such vigorous activities as volleyball.

Although in some places public facilities are provided for enabling individuals to take showers, in many, if not most, other places no public showers are available. In the latter case, the active individual is faced with the problem of somehow getting cleaned up, especially if the individual has driven his or her vehicle to the place of outdoor activity and does not want to get sweat and salt particles on the vehicle upholstery and sand on vehicle floor.

The same, of course, also applies to such outdoor activities as camping, fishing, cycling, jogging, hiking, rollerbladeing, soccer, baseball, volleyball and many other vigorous activities where a participant would like to shower or otherwise get cleaned after the activity ends, but where public showering facilities ordinarily do not exist.

So far as is known to the present inventor there are available to the public no truly portable, pressurized shower apparatus that can be readily carried by an individual to a location where the apparatus can be conveniently used by the individual or another as needed or desired.

A principal objective of the current invention is, therefore, to provide a truly portable shower device that is compact, light in weight and can be pressurized so as to provide a convenient and sustained flow of washing or shower water.

Another important objective of the current invention is to provide a portable shower apparatus which can be easily transported by an individual, and which is not only convenient and simple to use but is, at well, relatively inexpensive to buy. Because of a pressurized water flow and the ability to provide warm water, the removal of soap, shampoo and rinses is complete, leaving little, if any, residue on the user. In the case of HealthCare personnel washing a patient, the patient will feel truly bathed and attended to, all with the advantage of minimal staffing being needed.

SUMMARY OF THE INVENTION

In accordance with the present invention, there is provided a portable shower apparatus which comprises a pressure vessel capable of withstanding an internal pressure of at least about 50 psig. The vessel is formed having an liquid filling and emptying opening and associated means for sealing the opening against pressure loss when the vessel is pressurized, and having a pressurized fluid outlet fitting.

Included are elongate liquid discharge conduit and means for detachably attaching a proximal end of the conduit to the pressure vessel outlet fitting. A manually-operated shower valve is attached to the distal end of the hose for controlling the flow of pressurized liquid from the vessel through and out of the discharge conduit. Means are included for enabling the pressurizing of said vessel. Further included are pressure relief means connected to the vessel for automatically venting the pressure when the pressure in the vessel therein reaches a preestablished level.

The vessel is preferably sized for containing at least about two gallons of water. The means for pressurizing the vessel include a valve stem, of a type installed in vehicle tire rims for enabling pressurizing of an associated tire, installed through a vessel wall for enabling the pressurizing of the vessel from a pressure source, which is preferably a carbon dioxide cylinder.

In a preferred embodiment, a temperature gauge is installed through a vessel wall for enabling a user to determine the temperature of water contained in said vessel, and a pressure vent valve is installed through a vessel wall for enabling the manual release of pressure from the vessel. Moreover, a pressure gauge is installed through a vessel wall for enabling a user to determine the pressure in the vessel. A carrying handle is detachable attached to the vessel.

An insulating cover is preferably included and is installed around at least major regions of the vessel, and preferably includes a storage pouch attached to the insulating cover. A shoulder strap may be attached to the insulating cover for enabling a user to carry the apparatus from the shoulder.

Preferably, the means for pressuring the vessel also, or alternatively, includes a pump disposed in the vessel and which is connected for manual operation by the handle.

BRIEF DESCRIPTION OF THE DRAWINGS

The present invention can be more readily understood by a consideration of the following detailed description when taken in conjunction with the accompanying drawings, in which:

FIG. 1 is a perspective drawing of a portable shower apparatus in accordance with a preferred embodiment of the present invention, showing a pressure vessel for containing water and showing attached to the vessel a an elongate hose having a shower head at the free end thereof, and further showing the apparatus in use;

FIG. 3 is a partially cut-away side elevation view off the apparatus of FIG. 1 showing internal and external features of the apparatus.

In the various FIGS., the same elements and features are given the same reference numbers.

DESCRIPTION OF THE PREFERRED EMBODIMENT

Figure 2:
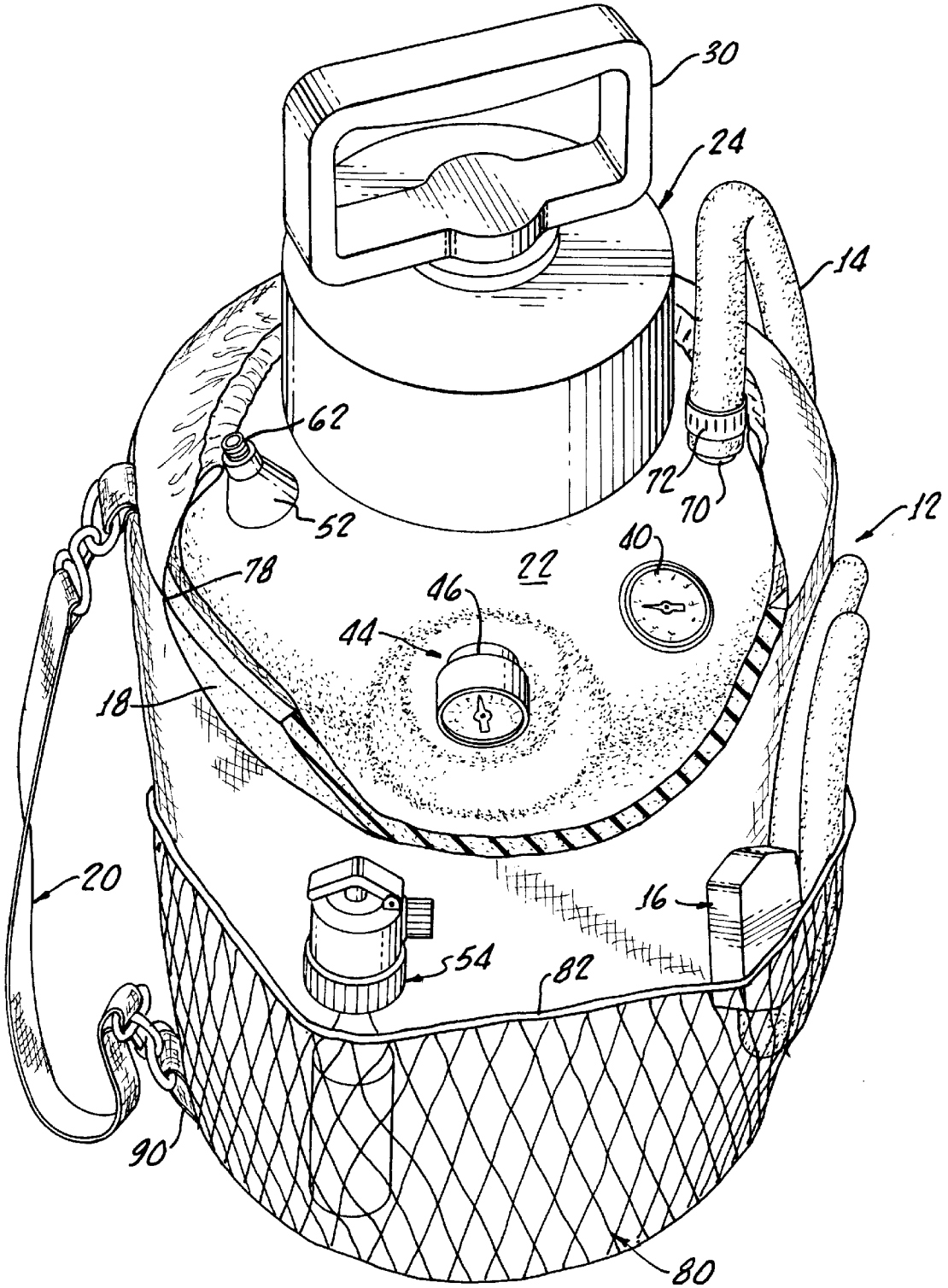
FIG. 2 is a partially cutaway perspective drawing of the portable shower apparatus of FIG. 1, showing the principally the pressure vessel and a temperature gauge, a combination pressure gauge and pressure relief valve and a vessel pressurizing valve, and showing the hose and shower head in a stowed condition.

There is shown in FIG. 1, a portable shower device or apparatus 10 in accordance with a preferred embodiment of the present invention. It is to be understood that although apparatus 10 is described and claimed herein generically as a shower apparatus, it can obviously be used for less than a total shower. Apparatus 10 may obviously be used for washing just an individual's hair or may be used to wash only a portion of an individual's body, just as a common, permanently-installed household may be used for less than a total shower.

Shown generally comprising portable shower apparatus 10, and as more particularly described below, are a pressure water tank or vessel assembly 12, an elongate shower hose 14 having a proximal end connected to upper regions of the vessel, a shower nozzle or spray head 16 and an insulating cover or jacket 18 covering major regions of the vessel and having detachable attached thereto a shoulder-type carrying strap 20.

More particularly described and as shown in FIGS. 2 and 3, pressure vessel assembly 12 includes a vessel body 22 for containing water and a handle sub-assembly 24 that threads into or onto an upper end region 26 of the vessel body and includes conventional means for sealing the vessel body against water leaking therefrom for closing the vessel body.

Preferably, as depicted in FIG. 3, handle sub-assembly 24, which releasable locks to vessel body 22, comprises a carrying handle 30 and a pressure pump 32, by mean of which vessel body 22 can be pressurized (by repeated pumping action by handle 30) if desired or needed, as further mentioned below. Handle sub-assembly 24 is constructed so that it can be removed from vessel body 22 so that the vessel body can be filled with water through an opening 25 in upper end region 26 of the vessel body (FIG. 3). Handle sub-assembly 24 may, for example, comprise or be similar to the handle and pump assembly used on many types of pump-type garden sprayers.

Vessel body 22 is preferably constructed of a tough plastic material, such as polyethylene, and has a diameter, D, of about ten to twelve inches and a height of about eighteen to about twenty inches. According to size of vessel 22, different water capacities, for example, one gallon, one and one-half gallons or preferably at least about two and one-quarter gallons, of water may be provided. The wall thickness of vessel body 22 is selected so that the vessel body can withstand at least about fifty psig, and preferably as much as about one hundred psig, without bursting; although, at such pressure, vessel body may be damaged and should be replaced without being further used.

As shown in FIG. 2, vessel body 22 preferably has installed through an upper wall region thereof a temperature gauge 40 from which can be read the temperature of water 42 (FIG. 3) contained in the vessel body. Very preferably, further installed through a wall of vessel body 22 is a combination pressure gauge and pressure relief device 44. A user can tell from a pressure gauge portion 46 of the combination pressure gauge and pressure relief device 44 when vessel body is properly pressurized and when the vessel body is un-pressurized. In addition, pressure gauge portion 46 provides an indication of about how much water remains by showing how much pressure is left in vessel body 22 after full pressurization of the body.

Pressure gauge portion 46 is preferably "red-lined" on its face with the maximum pressure to which vessel body 22 is to be pressurized, for example, at about twenty-five to about thirty psig.

The associated pressure relief portion is preferably set at about ten to fifteen psig higher than the red-lined pressure on gauge portion 44, and preferably comprises a conventional spring-type pressure valve. As an illustration, pressure may be automatically released at about 45 psig. As an alternative, pressure relief may be provided comprise a stand-alone device which may be separately installed in vessel body 22 above an maximum fill level mark 50 (FIG. 3) around an inner surface 51 of the vessel body.

It is preferred that vessel assembly 12 further include a valve stem 52 of the type used in vehicle tire rims be installed through a wall of vessel body 22 above maximum fill level mark 50 (FIGS. 2 and 3). Valve stem 52 enables the convenient pressurization of vessel assembly 12 by means of a compressed carbon dioxide ($CO_2$) gas "gun" 54 of the type commonly available at bicycle shops for inflating bicycle tires as an alternative to hand operated bicycle tire pumps.

As shown, gas gun 54 comprises a head 56 which engages valve stem 52 and which included an operating trigger 58 for releasing the $CO_2$, and which receives a conventional $CO_2$ cylinder 60. For pressurizing vessel body 22, when vessel body is initially filled with water, for example, to fill level mark 51, or when pressure in the vessel body is substantially reduced during use of apparatus 10, gas gun 54 is positioned to engage valve stem 52. Trigger 58 is then depressed until the desired pressure in vessel assembly 12 is reached, as indicated by pressure gauge portion 46. Gas gun 54 is then removed from valve stem 52 and a valve cap 62 is installed on the valve stem (FIG. 2).

Such use of gas gun 54 to pressurize vessel assembly 12 is preferred, because of ease of use, over pressurizing the vessel assembly by actuation of hand pump 32. Nevertheless, if the $CO_2$ cylinder 60 is empty or nearly so, and if no full $CO_2$ cylinder is available, pump 32 is useful.

Pressure venting from vessel assembly 12 may be desired, for example, when the partially filled, pressurized vessel assembly is to be filled up or before attempting to release handle sub-assembly 24 from the vessel assembly when the vessel assembly is still pressurized. Pressure may be manually vented from body 22 by partial loosening handle 30, by manual release of device 44 or by depressing the valve stem in valve stem 52.

A hose connector fitting 70 is installed through an upper wall region of vessel body 22 (FIGS. 2 and 3). A proximal end of hose 14, which is preferably at least about six feet long, is attached to hose connector fitting 70 and is retained thereon by a conventional hose clamp 72. A standpipe 74 extends down from hose connector fitting 70 into lower regions of vessel body 22 (FIG. 3).

It has been found by the present inventor that manually-operated shower nozzle 16, which is detachably attached to the distal end of hose 14, may advantageously comprise a type 421 thumb control spray head available from the Modern Manufacturing Co.

Insulated cover 18 is advantageously fit around at least most of vessel body 22 so that water in vessel assembly 12 can be kept hot or warm for a substantial period of time. Thus, for example, vessel body 22 may be filled with hot water before leaving home and insulating cover 18 will keep the water at least warm for several hours. A drawstring 78 is provided around the top of insulating blanket 18 (FIG. 2) to keep the blanket closed around vessel body 22.

A fabric net skirt or pouch 80 with an elastic upper edge 82 is advantageously attached around at least lower regions of insulated cover 18 (FIGS. and 2). Pouch 80 can be used to store gas gun 54 and distal regions of hose and shower nozzle 16 as shown in FIG. 2. In addition pouch 80 may be used to store and keep at hand such other items as soap and a washcloth (not shown) and personal items of the user.

A strap 90 (shown in dotted lines in FIG. 1, is attached across the bottom outside of cover 18 by means of which the cover may be pulled of from vessel body 22.

Operation of portable shower apparatus 10 is simple and convenient and is obvious from the above description, and will, therefore, be only briefly summarized. Assuming any pressure in vessel assembly 12 has been released by operation of vent valve 64, handle sub-assembly is detached from vessel body 22, which is then filled, for example, with water to fill mark 50. Handle sub-assembly 24 is then reinstalled and locked onto vessel body 22. Pressurization of vessel assembly 12, by gas gun 54 or by hand pump 32, is not ordinarily accomplished until portable shower apparatus 10 is ready to be used, at which time the vessel assembly is pressurized to the desired level (below the safety limit).

Once filled and pressurized, water is discharged from shower apparatus 10, through shower hose 14, by manual operation of shower nozzle 16, as depicted in FIG. 1, for cleaning off a user's foot 90.

It will be appreciated that portable shower apparatus can additional be used, as an illustration, a user's surfboard or articles of wear, such as sandals. In fact, portable shower apparatus 10 can be used in any application requiring personal cleaning, such as hair washing, where no source of water is otherwise provided.

Although there has been described above a portable shower apparatus in accordance with the present invention purposes of illustrating how the present invention maybe used to advantage, it is to be understood that the invention is not limited thereto. Consequently, any and all variations and equivalent arrangements which may occur to those of skill in the applicable art are to be considered to fall within the scope and spirit of the invention as set forth in the claims which are appended hereto as part of this application.

What is claimed is:

1. A portable water shower apparatus which comprises:

a. a pressure vessel capable of withstanding an internal pressure of at least about 50 psig, said vessel being formed having a liquid filling and emptying opening and associated means for sealing said opening against pressure loss when the vessel is pressurized, and having a pressurized fluid outlet fitting;

b. an elongated fluid discharge conduit and means for detachably attaching a proximal end of the conduit to said pressure vessel fluid outlet fitting;

c. a manually-operated valve attached to the distal end of said discharge conduit for controlling the flow of pressurized fluid from the vessel through and out of said discharge conduit;

d. means for enabling the pressurizing of said vessel;

e. pressure relief means connected to said vessel for automatically venting said vessel when pressure therein reaches a preestablished level; and f. an insulating cover installed around at least major regions of the vessel, said insulating cover having attached thereto a storage pouch and including a shoulder strap attached to said insulating cover for enabling a user to carry the apparatus from the shoulder.

2. The portable shower apparatus as claimed in claim 1, wherein said vessel is sized for containing at least about two gallons of water.

3. The portable shower apparatus as claimed in claim 1, wherein said means for pressurizing said vessel includes a valve stem installed through the vessel for enabling the pressurizing of the vessel from a pressure source.

4. The portable shower apparatus as claimed in claim 3, wherein said pressure source includes a carbon dioxide cylinder.

5. The portable shower apparatus as claimed in claim 3, wherein said valve stem is the type installed in vehicle tire rims for enabling pressurizing of an associated tire.

6. The portable shower apparatus as claimed in claim 1, including a temperature gauge installed through said vessel for enabling a user to determine the temperature of water contained in said vessel.

7. The portable shower apparatus as claimed in claim 1, including a pressure vent valve installed in the vessel for enabling the manual release of pressure from the vessel.

8. The portable shower apparatus as claimed in claim 1, including a pressure gauge mounted to the vessel for enabling a user to determine the pressure in the vessel.

9. The portable shower apparatus as claimed in claim 1, including a carrying handle detachable attached to said vessel.

10. The portable shower apparatus as claimed in claim 9, wherein the means for pressuring the vessel includes a pump disposed in said vessel and connected for manual operation by said handle.

* * * * *